US006073634A

United States Patent [19]

Gueret

[11] Patent Number: 6,073,634

[45] Date of Patent: Jun. 13, 2000

[54] UNIT FOR THE PACKAGING AND APPLICATION OF A MAKE-UP PRODUCT FOR KERATINOUS FIBERS

[75] Inventor: Jean-Louis H. Gueret, Paris, France

[73] Assignee: L'Oreal, Paris, France

[21] Appl. No.: 09/026,914

[22] Filed: Feb. 20, 1998

[30] Foreign Application Priority Data

Feb. 21, 1997 [FR] France ..... 97-02108

[51] Int. Cl.[7] ..... A45D 40/26

[52] U.S. Cl. ..... 132/218; 132/293

[58] Field of Search ..... 132/218, 294, 132/314, 320, 293; 401/123, 125

[56] References Cited

U.S. PATENT DOCUMENTS

| | | |
|---|---|---|
| 2,180,404 | 11/1939 | Eastley . |
| 3,921,650 | 11/1975 | Montgomery . |
| 4,165,755 | 8/1979 | Cassai . |
| 4,579,133 | 4/1986 | Seidler . |
| 4,726,387 | 2/1988 | Sarica . |
| 4,898,195 | 2/1990 | Sussman . |
| 5,135,112 | 8/1992 | Kamen et al. . |

FOREIGN PATENT DOCUMENTS

| | | |
|---|---|---|
| 0238208 | 9/1987 | European Pat. Off. . |
| 0556081 | 8/1993 | European Pat. Off. . |
| 2564712 | 11/1985 | France . |
| 8901874 | 5/1989 | Germany . |
| 59-117417 | 8/1984 | Japan . |
| 60-70216 | 5/1985 | Japan . |
| 60-168404 | 8/1985 | Japan . |
| 61-64817 | 5/1986 | Japan . |
| 61-194417 | 12/1986 | Japan . |
| 63-84504 | 4/1988 | Japan . |
| 6-13714 | 2/1994 | Japan . |

*Primary Examiner*—Todd E. Manahan

*Attorney, Agent, or Firm*—Oblon, Spivak, McClelland, Maier & Neustadt, P.C.

[57] ABSTRACT

A unit for the packaging and application of a make-up product for keratinous fibers, in particular eyelashes, includes a body having a bottom in which a block of the product is disposed, a lid for covering the bottom in a detachable manner, and an applicator device including a handle of a substantially flat profile, and carrying at least one applicator element having a free end. The applicator element is formed by a plurality of bristles implanted on a first end of the handle along an arrangement parallel to a plane of the handle, the width of the applicator element being greater than 7.5 mm, the thickness of the free end of the applicator element being from 0.5 mm to 5 and the length of the applicator element being from 4 mm to 60 mm.

45 Claims, 5 Drawing Sheets

UNIT FOR THE PACKAGING AND APPLICATION OF A MAKE-UP PRODUCT FOR KERATINOUS FIBERS

BACKGROUND OF THE INVENTION

1. Field of the Invention

The invention relates to a unit for the packaging and application of a make-up product for keratinous fibers, packaged in the form of a "loaf" or "cake" of a solid or semi-solid consistency. The invention is eminently suitable for the packaging and application of mascara to the eyelashes.

2. Description of the Related Art

Numerous devices have been proposed for applying and packaging mascara. "Loaf" mascaras, for example, are used with a brush 3 (FIG. 1) of the shoe polish-type in which the ends of the brush bristles 6 are rubbed over a moistened loaf of mascara. The application surface of the mascara is the surface formed by the ends of the bristles of the brush. The brush 3 charges an eyelash 2 with the bristles 6 perpendicular to the longitudinal axis of the lash. The variation of the charge is proportional to the viscosity of the paste formed by the moistened loaf. The use of such a device is tedious—it requires the preparation and prior dosing of the paste—and the make-up action is not very precise. Moreover, in the course of use, the surface of the "loaf" becomes hollowed out. It then becomes difficult to charge the brush correctly via the free ends of the bristles, and the quality of the make-up suffers considerably. Finally, such brushes quickly clog up by the deposit of the product between the bristles of the brush. Moreover, by reason of their shape, such brushes substantially increase the size of the case used for the packaging of the product. It is, in particular, very difficult to make such a case in a flat shape.

In the field of liquid mascaras, French Patent No. 2 564 712 discloses the use of a brush whose free end carries a small number of axially disposed bristles for applying small quantities of a cosmetic product in narrowly confined zones such as the corners of the eyes. The application of the cosmetic product, such as mascara, over the main part of the arc of the user's eyelashes is done by means of a conventional brush, either separate from the brush with the axial bristles, or formed by radially disposed bristles on the brush stem whose end carries radial bristles (see FIG. 8 of French Patent No. 2 564 712). According to this document, the applicator is immersed in the product in the storage position.

U.S. Pat. No. 4,726,387, discloses a case comprising a bottom with a lid articulated thereon. An applicator formed by a brush with a high density of fine bristles, arranged at the end of a handle, is disposed inside the case in a compartment separate from the compartment containing the product. The handle situated outside the case is used to open the lid by pivoting the handle around its axis. A drawback of this device is that the pivoting movement of the handle is accompanied by a pivoting movement of the brush inside the case, which may damage the brush. Finally, the document is silent as to the dimensions of the brush, as these dimensions do not constitute critical parameters of the applicator when used in the conventional way, in which the ends of the bristles are brought into contact with the surface to be treated for the application of a waxy finish, a foundation, an eyeshadow, etc.

SUMMARY OF THE INVENTION

It is one of the objects of the present invention to provide a unit for the packaging and application of a make-up product for keratinous fibers, in particular the eyelashes, in the form of a solid or semi-solid block intended to be applied by an applicator device which ensures a better charging of the keratinous fibers, in particular eyelashes, as well as an optimum separation of the lashes, while being extremely simple to use.

It is another object of the invention to provide such a case for packaging and application which is of a reduced size as compared with the conventional cases.

It is yet another object of the invention to provide a unit for the packaging and application of a make-up product for the keratinous fibers in a solid or semi-solid form, by an applicator device which can be homogeneously charged irrespective of the profile of free surface of the block of a product.

In accordance with the invention, these and other objects are attained by making a unit for the packaging and application of a make-up product for keratinous fibers, in particular the eyelashes, comprising a body having a bottom in which there is disposed a solid or semisolid block of the product having a free surface, and a lid for covering the bottom in a detachable manner, an application device comprising a handle with a longitudinal axis and with a substantially flat profile and carrying at least one applicator element which, in the storage position, is disposed inside the unit without any substantial contact with the product, and having a free end. The applicator element is constituted by a plurality of bristles implanted on a first end of the handle along an arrangement that is substantially parallel to a plane of the handle, the width of the free end of the applicator element measured along a first direction parallel to the plane being greater than or equal to 7.5 mm, the thickness of the free end of the applicator element measured along a second direction perpendicular to the plane being from 0.5 mm to 5 mm, and the length of the applicator element measured along a third direction perpendicular to the first and second directions being from 4 mm to 60 mm.

Thus, the invention comprises a compact-type packaging and application unit having a body and a lid, in which there is disposed a solid or semi-solid block of a product, in particular a mascara, in combination with an applicator whose dimensional characteristics cooperate for taking up the product at the free surface of the product in the best way and to restore it in the best way, with a view to obtaining a better-quality, simpler and faster make-up action, with a handling action different from the conventional application units.

For this purpose, the applicator has a length sufficient to allow its bristles to be placed in contact with the free surface of the product over a substantial part of their length and, by inclining the applicator element to a sufficient extent relative to the free surface of the product, thus to allow the bristles to be charged with the product over a substantial portion of their length (substantially from their base to their end). This is in contrast to conventional brushes where the charging with the product is mainly effected by the ends of the bristles. The restitution of the product is also effected by bringing the bristles of the brush into a tangential contact with the fibers to be treated, by smoothing the keratinous fibers, in particular the eyelashes, over their whole length from their base towards their end, the bristles of the brush touching the eyelashes tangentially.

Moreover, the applicator element has a sufficient width to allow a rapid and homogeneous make-up of the surface to be treated, in particular an arc of eyelashes. In the case of a mascara for the lashes, the width of the free end of the applicator element is at least equal to a quarter of the average width of an arc of eyelashes. Within the meaning of the present application, the term "arc of eyelashes" designates the average curve (typically in a circular arc) wherein the lashes of an adult person are implanted. Typically, the average width of an arc of eyelashes varies for an adult approximately between 3 cm and 4 cm. With a brush with a width less than approximately ¼ of the average width of an arc of the eyelashes, the homogeneity of the make-up is not satisfactory.

Advantageously, the width of the free end of the applicator element is at most equal to, and preferably slightly smaller than, the width of the loaf of the product so that, in the course of use, the free surface of the product is "worn away" in a substantially uniform way and so that the applicator is charged in a substantially uniform way over the whole of its width, including the edges.

More advantageously, the width of the applicator element, measured along the first direction, is substantially smaller than the width of the first end of the handle, the applicator element being centered on the first end of the handle along said first direction. In other words, the handle is extended on either side of the applicator element. In particular, when the applicator element alone is packaged in the unit and the handle is kept outside the unit, the reduced size of the applicator element relative to the handle makes it possible to facilitate putting the applicator element into the storage position, and to avoid damaging the bristles, which would reduce its efficiency to a considerable extent. Advantageously, the difference in width between the first end of the handle and the applicator is from 1 mm to 5 mm and preferably from 2 mm to 4 mm.

Finally the applicator element has a sufficiently small thickness to avoid clogging up of the brush and to allow any product which may have dried on the brush between two uses to be quickly resolubilized during the following use.

According to another advantageous aspect of the present invention, the bristles are more thinned out than in the conventional brushes or pencil brushes used in the field of make-up. This allows a faster and more uniform make-up of the fibers to be treated, from their base to their end, as well as a better separation of the fibers after product application. Moreover this low density, in combination with the dimensional characteristics of the brush, and in particular its thickness, participates in resolving the problem of the clogging up of the applicator element still further by permitting in particular faster resolubilizing of the product which may have dried up between use on separate occasions. For this purpose, and according to another advantageous characteristic of the invention, the ratio $\Phi$ of the effective surface of the set of bristles (that is to say, the total number of bristles multiplied by their average cross-section) and the overall surface of the cross-section of the envelope circumscribed by that set of bristles, taken at the level of the free end of the applicator, (designated hereafter as the surface of the free end of the applicator element) is from 0.10 to 0.5, and preferably from 0.15 to 0.35. This relatively low density makes it possible, moreover, to obtain an applicator element whose width in the vicinity of its free end is substantially identical to the width of the applicator element in the vicinity of its end adjacent to the handle. The risk of damaging the bristles, particularly by "goring" of the bristles, is distinctly lower and the make-up is more precise. In the conventional applicator elements, because of the unduly high number of bristles, the applicator element is wider in the vicinity of its free end than in the vicinity of its end next to the handle.

As mentioned above, in the closed position of the lid on the bottom, the handle can be situated, at least in part, on the outside of a substantially enclosed space formed by the lid and the bottom, the applicator element being situated inside the enclosed space without any substantial contact with the product. This arrangement makes it possible to reduce substantially the size of the case, in particular in thickness and/or in width. Moreover, the handle is thus isolated from the product, which allows it to be kept clean. Such a configuration makes it possible to give the make-up unit a shape close to that of devices used for the liquid formulas of mascara. Furthermore, the shape can be made less commonplace.

Because of its structure, its mode of charging (by contact of the bristles over a substantial portion of their length and not at their ends), and its small thickness, the applicator element will not be clogged up to any great extent and will resolubilize the dry product instantaneously. On the other hand, the mixture of the product/solvent (saliva for example) can be obtained by rubbing the ends of the bristles over the surface of the product The free end of the bristles is advantageously used to separate the lashes after the product application.

With such a substantially flat configuration of the handle, it can be (easily held between the thumb and the forefinger. Furthermore, in the case of a mascara, the application of the product is no longer effected in an uncertain manner by causing the applicator to pivot along its axis as in the case of the known applicators, but by smoothing the keratinous fibers, and the eyelashes in particular, over their whole length from their base towards their end with the bristles touching the eyelashes tangentially. The movement is much simpler than with the known applicators. It is, moreover, possible to incline the applicator at will, and thus to curve the eyelashes back according to the curve desired.

According to one embodiment, the lid is slidably mounted on the bottom, the handle acting as an actuating element to produce the opening of the packaging and application unit and to allow access to the block of the product. This arrangement makes it possible to dispense with auxiliary opening means which are frequently complicated, expensive and fragile. Alternatively, the lid can be articulated on the bottom.

The handle may be obtained by molding an elastomeric or thermoplastic material. It may be formed by two parts articulated around an axis of articulation parallel to the first direction. This articulation permits an inclination of the applicator element relative to the handle and improves the handling action. Such an axis of articulation may be formed by a film hinge or a profiled section. Preferably, in the closed position of the lid on the bottom, the axis of articulation is inside the case, so as to immobilize the handle in relation to said plane.

According to yet another aspect of the invention, the end of the handle on the opposite side to the first end carries an auxiliary element for separating the keratinous fibers after the application of mascara, for example. Such a separating element advantageously completes the combing provided by the free end of the bristles, which combing can be rendered difficult by the presence of residual mascara on the bristles of the brush. Such a separating element may be formed by a comb, the body of the case when in its closed position being capable of functioning as a handle for the comb. Such a comb may be made by being molded together with the handle. Alternatively, the separating element is formed by a brush comprising an arrangement of bristles disposed radially on a central core.

The product may be introduced into the bottom by compacting, by casting in a hot or cold state, or directly in the form of a block joined to the bottom by my appropriate means (bonding for example). The free surface of the product may be flat or form a convex or concave profile. The structure of the applicator is suitable for perfectly assuming such a profile, and hence permits a homogeneous charging. Alternatively, a semi-solid block is made in the form of a block of foam with open cells or half-open cells, wherein the product is impregnated in a fluid form. This formation makes it possible to have a product available ready for use without the need for moistening it beforehand. By way of example, a foam of polyurethane, polyvinyl chloride, polyethylene, epoxy resin or polystyrene is used.

Advantageously, the width of the free end of the applicator element is from 0.75 cm to 3 cm. The thickness of said end is preferably at most equal to the thickness of the handle. Preferably, the length of the applicator element is from 10 mm to 30 mm, and more preferentially from 15 mm to 20 mm. The bristles may have different shapes and lengths and may comprise capillary grooves or asperities, these different configurations ensuring a better charging of the product on the lashes and a better separation of the lashes.

The diameter of the bristles may vary from 0.04 to 0.7 mm, and preferably from 0.05 to 0.6 mm, and even more preferentially from 0.06 mm to 0.4 mm. The bristles may be of a flexible to rigid consistency, and may preferably be flexible to semi-rigid. The relative rigidity ensures a more efficient smoothing of the lashes and a very good curving back of the lashes. Typically, their hardness may be from 10 Shore A to 90 Shore D, and preferably from 30 Shore A to 60 Shore D.

The bristles of the applicator element may be formed by synthetic materials, metals, elastically deformable metals such as elastomers, thermoplastic elastomers, vulcanized elastomers or thermoplastic materials. Advantageously, the bristles are made of a thermoplastic material molded in a duplex injection mode together with the handle, are extruded, or are formed by a mixture of the two. Advantageously, the bristles are shaped in tufts disposed in parallel lines or in a staggered arrangement.

The bristles may be made of an elastically deformable material, of metal, glass or wood. The handle of the applicator may be made of a plastic material. It is thus possible to obtain an applicator comprising only organic materials. The particular length of the bristles, as well as their different shapes ensure a charge on the lashes adapted to the user's wishes. Thus, it is possible to mix fine bristles, thick bristles, short bristles, longer ones, flocked bristles, bristles molded on the handle in a duplex injection mode, extruded bristles, bristles having asperities, and/or bristles of various stiffness according to the desired charge. Thick and flocked bristles, will produce a heavier charge of mascara on the eyelashes. More rigid bristles, as well as a particular inclination of the handle, will ensure ideal curving back of the lashes. Finally, the bristles may also include slip agents such as molybdenum disulphide, bactericidal agents such as the Microban® product sold by the Microban Product Company, or moisture absorbing agents which soften the bristles and modify their surface tension.

The bristles of the applicator element may have undulations. Their free ends may end in balls obtained, for example, by carding. The maximum interspacing between two bristles measured at the fixed end of these bristles may be of the order of 3 mm. The tuft or tufts of bristles may be cut along a tapered, convex or concave shape.

According to another characteristic of the invention, the applicator device may have a second applicator element instead of the comb or disposed inside the handle head-to-tail relative to the first. Alternatively, the handle may be detachable from the brush, which permits a selective use of one or the other of the brushes for the application and/or the combing of the keratinous fibers. The second brush may be contained either inside the handle or inside a second compartment provided in the case. This second applicator element may comprise bristles implanted, or cut or subjected to processing, in a way different from that of the first applicator element, with a view to introducing still more variability into the make-up. By way of a further variant, the second applicator element is a "liner".

BRIEF DESCRIPTION OF THE DRAWINGS

Apart from the arrangements set out above, the invention consists of a certain number of other arrangements which will be explained below with regard to nonrestrictive examples of the embodiment, described with reference to the attached Figures, wherein.

DETAILED DESCRIPTION OF THE PREFERRED EMBODIMENTS

Referring to FIGS. 2, 3 and 4A–4I, a number of characteristics of an applicator device such as may be used in the packaging and application unit in accordance with the invention are described in order to simplify the description of the case unit which will be made in a more general way with reference to FIGS. 5 to 11.

Figure 3:
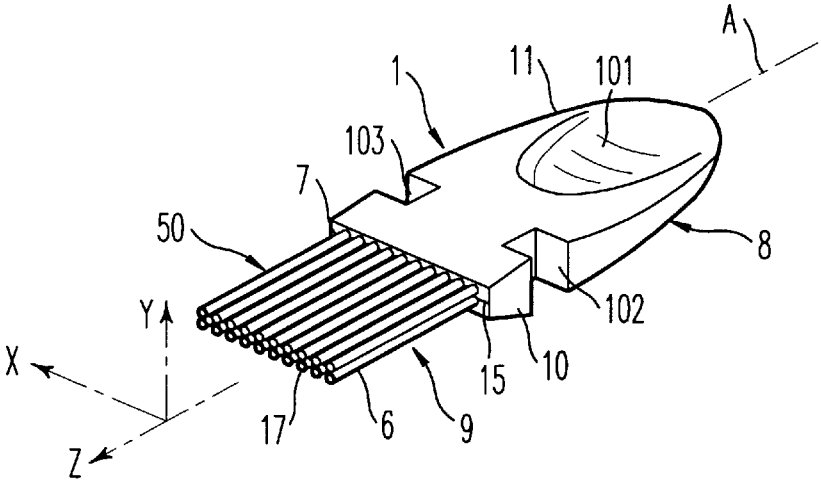
FIG. 3 is a view in perspective of an embodiment of an applicator device such as that used in the packaging and application unit in accordance with the invention.

According to the embodiment illustrated in FIG. 3, the application device 1 comprises a handle 8 and tufts 9 of bristles 6 forming the applicator 50. The handle 8 has a substantially flat shape. The term "substantially flat" means a structure of a small thickness relative to its other dimensions, and in particular relative to its length. By way of example, the handle may have a profile that is slightly curved axially in the manner of a tile, the implantation of the bristles following the curvature of the handle. Alternatively, the handle may be flexible to allow the user to give it a slightly convex shape during the application, so as to conform substantially to the curvature of the arc of the eyelashes. In the embodiment shown, the handle has a first end 10 wherein the tufts 9 of the bristles 6 are directly and substantially axially implanted, and a second part 11 tapered towards the end on the opposite side to the first end 10, and having on at least one of its sides a sunk portion 101 capable of facilitating the gripping of the handle by the user. As will be clearly seen in FIG. 3, as well as in other drawings, the implantation width of the bristles or tufts is smaller than the width of the end 10 of the handle wherein they are implanted. Typically, the handle may be extended by 1 mm to 2 mm on either side of the applicator element. Substantially at the interface between the first end 10 and the second part 11, the handle defines two substantially U-shaped grooves 102, 103 which serve for the mounting of the applicator device in the packaging and application unit.

A first direction X is contained in a median plane of the part 10 of the handle 8 and directed perpendicularly to the longitudinal axis A of this handle. A second direction Y is perpendicular to the plane of the part 10 of the handle 8, and a third direction Z is perpendicular to directions X and Y. The tufts 9 of the bristles 6 are implanted in the first end 10 parallel to the median plane of the part 11 and along a direction substantially parallel to the third direction Z. In practice, the bristles may slightly diverge or slightly converge relative to the direction Z. Within the meaning of the present application, the bristles may also be disposed along a line that is very slightly curved so as to promote still further the application to the eyelashes. By way of an example, the handle has an average length measured along direction Z ranging from 1 cm to 6 cm, and preferably ranging from 2 cm to 5 cm. Its average thickness along the second direction Y varies from 2 mm to 7 mm, and preferably from 2 mm to 5 mm. Its average width along the first direction X varies from 7.5 mm to 40 mm and preferably from 10 mm to 35 mm.

The tufts of bristles are arbitrarily implanted, bonded, held, or molded in a duplex injection mode, in the first end 10. They are disposed in rows 7, two adjacent bristles 6 being interspaced by at most 3 mm measured at their base 15 and along the first direction X, and by at most 2 mm measured at their free end 17 along the first direction X. In FIG. 3, the tufts of bristles are disposed in two parallel rows 7 and aligned opposite one another.

The width of the set of tufts 9 of bristles 6 measured at the free end of the bristles along the first direction X is greater than 0.75 cm, and preferably is from approximately 0.75 cm to 3 cm. The thickness of the set of the tufts 9 of bristles 6, also measured at the free end of the bristles and along the direction Y, is at most equal to the thickness of the handle, in particular of the part 11, measured along the second direction Y. In accordance with the invention, good results have been obtained with a thickness chosen in the range from 0.5 mm to 5 mm, and preferably from 1 mm to 3.5 mm.

The population density of the bristles is generally less than the population density of the bristles of the brushes or pencil brushes commonly used for the application of products such as blushers. By way of example, an applicator element is formed by eight tufts of bristles aligned along a substantially straight line. Each tuft has between four bristles and two hundred bristles with a diameter that may vary from 0.06 mm to 0.7 mm. Reference is here made to "visible" bristles. In practice, two visible bristles may be formed from the same strand folded in two, the fold zone being implanted in the handle. The width of the applicator element (the width of the implantation of the bristles) is of the order of 2 cm. Its thickness is of the order of 2.5 mm. The ratio Φ of the effective surface of the set of bristles (that is to say the total number of bristles multiplied by their average cross-section) and the surface of the free end of the applicator element is from 0.10 to 0.5, and preferably from 0.15 to 0.35. More specifically, a brush may have eight tufts of bristles disposed in a substantially aligned manner. Each tuft has 200 visible bristles with a diameter of 0.08 mm. The width of the free end of the applicator element is of the order of 20 mm. Its thickness is of the order of 2.5 mm. The ratio Φ is 0.16.

According to a second specific example, a brush has eight tufts of bristles disposed in a substantially aligned manner. Each tuft has eight visible bristles with a diameter of 0.5 mm. The width of the free end of the applicator element is of the order of 20 mm. Its thickness is of the order of 2.5 mm. The ratio Φ is 0.25.

According to a third specific example, a brush has eight tufts of bristles disposed in a substantially aligned manner. Each tuft has four visible bristles with a diameter of 0.7 mm. The width of the free end of the applicator element is of the order of 20 mm. Its thickness is of the order of 2.5 mm. The ratio Φ is 0.24.

The length of the bristles 6, measured along the third direction Z is sufficient to allow the keratinous fibers, in particular eyelashes, to be charged along the axis of the bristles. This length generally ranges from 4 to 60 mm. Preferably, the length of the applicator element ranges from 5 to 40 mm, and even more preferentially, from 10 to 30 mm. In a still more preferred embodiment of the invention, the bristles 6 have a length ranging from 15 to 20 mm. The bristles generally have a diameter ranging from 0.04 to 0.7 mm, preferably from 0.05 to 0.6 mm, and even more preferentially from 0.06 to 0.4 mm.

The bristles may be of the same or different kinds, shapes or lengths. Thus, the bristles 6 of the applicator 1 may be natural or synthetic. They may be made of vegetable, animal or natural fibers, be made of metal such as steel, glass or wood, or of elastically deformable materials such as elastomers, vulcanized elastomers or thermoplastic materials. In particular, they may include thermoplastic bristles molded in a duplex injection mode on the handle, and/or be extruded. The bristles are preferably synthetic.

Figure 4A:
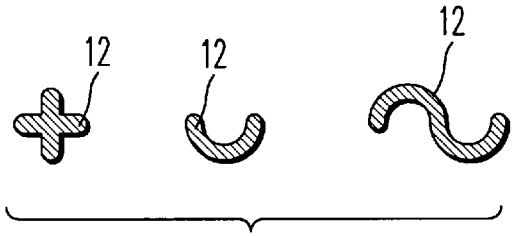
FIGS. 4A–4I illustrate other characteristics relating to the structure and the shape of the bristles of the applicator device that can be used in the packaging and application unit in accordance with the invention.
Figures 1, 4B:
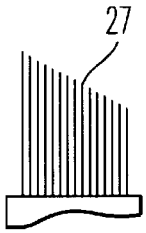
Figures 2, 4B:
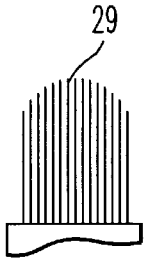
Figures 3, 4B:
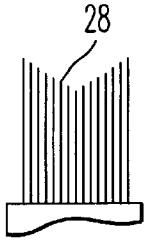
Figure 4C:
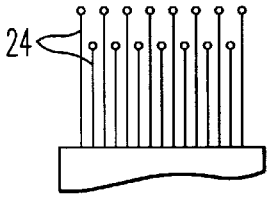
Figure 4D:
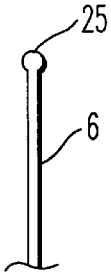
Figure 4E:
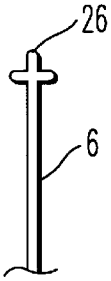
Figure 4F:
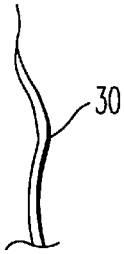
Figure 4G:
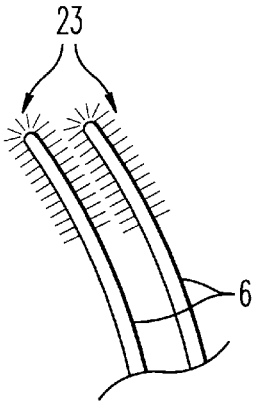
Figure 4H:
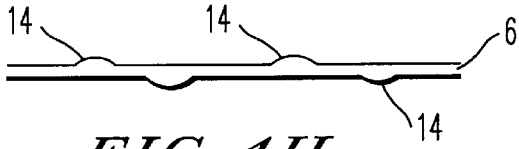

The bristles 6 may be flocked so as to have at their ends shorter bristles 23, as shown in FIG. 4G; their asperities and their different lengths may be obtained by milling perpendicularly or tangentially to the bristles, or by being shaped in their hot state. The bristles may have balls 24 obtained by carding, as shown in FIG. 4C. These balls 24 may be situated at different levels of the bristles. The bristles may have been bombarded by gamma or beta rays for modifying their surface state. They may have been milled for tapering. Their free ends may have the shape of a round-headed nail 25 as shown in FIG. 4D, or of a fork 26 as shown in FIG. 4E.

The bristles may have one or more capillary grooves of various cross-sections, such as the grooves 12 shown in FIG. 4A. The tufts of bristles may be cut along a bevelled shape 27 or along a concave shape 28 or convex shape 29, as shown in FIG. 4B. They may have asperities 14 like the bristle 6 shown in FIG. 4H. They may be curved or have undulations over their whole length like the curved bristle 30 shown in FIG. 4F. The applicator may also be provided with a flocked coating, that is to say a capillary foam, or a foam that can be impregnated, set between two rows of bristles. Such a flocked coating ensures a better charging of the bristles with mascara.

Figure 4I:
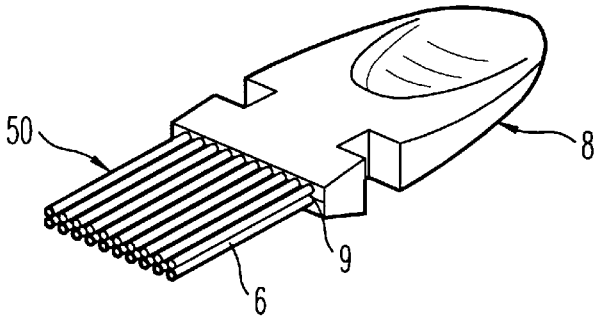

In the embodiment of FIG. 4I, the tufts 9 of bristles 6 of an applicator element 50 are disposed in a staggered arrangement.

Figure 1:
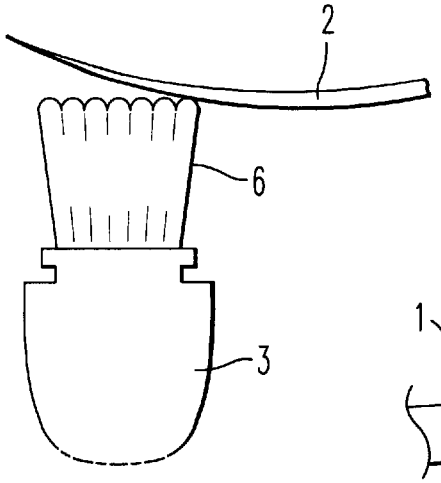
FIG. 1 is a sectional view illustrating the making up of an eyelash by a brush of the shoe polish-type, for a "loaf" mascara.
Figure 2:
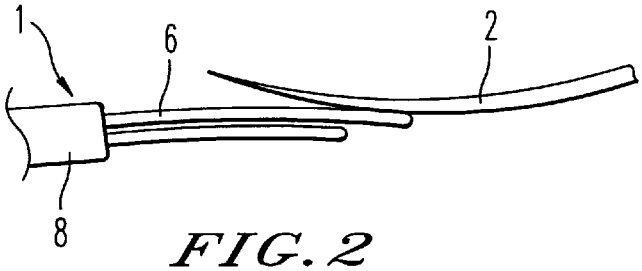
FIG. 2 is a sectional view illustrating the making up of a eye lash by an applicator device in accordance with the invention.

Using such an application device, the mascara is applied to the eyelashes in an extremely simple manner, the action for smoothing the lashes being effected upwardly from the base of the lashes towards their ends, the bristles 6 of the applicator handle 8 being parallel to the eyelashes 2. Such an application device 1 is shown in FIG. 2. Such a handling action is much more precise than that of the prior art. Indeed, the flat handle and the special configuration of this applicator make it possible to hold it easily during use and to obtain a better calculated make-up facing the lashes, due to a more ample and freer movement. Such an applicator allows the user actually to follow the bristles along the lashes and to charge the lashes in a very precise manner. Finally, the user can end the movement by inclining the applicator so as to bring the bristles perpendicularly to the lashes. She can thus perfectly separate and curve the lashes, thanks to the end tips of the bristles and/or by using an auxiliary separating device which will be described in greater detail below. Moreover, such an application device is very simple to make. The handle may be, for example, made of a molded plastic, wood or any other material generally used in the manufacture of applicators.

Figure 5A:
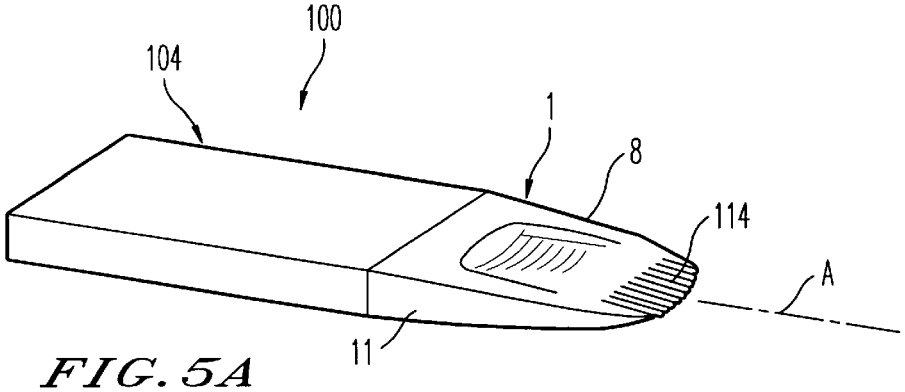
FIGS. 5A to 5C illustrate a first embodiment of the packaging and application unit in accordance with the invention.
Figure 5B:
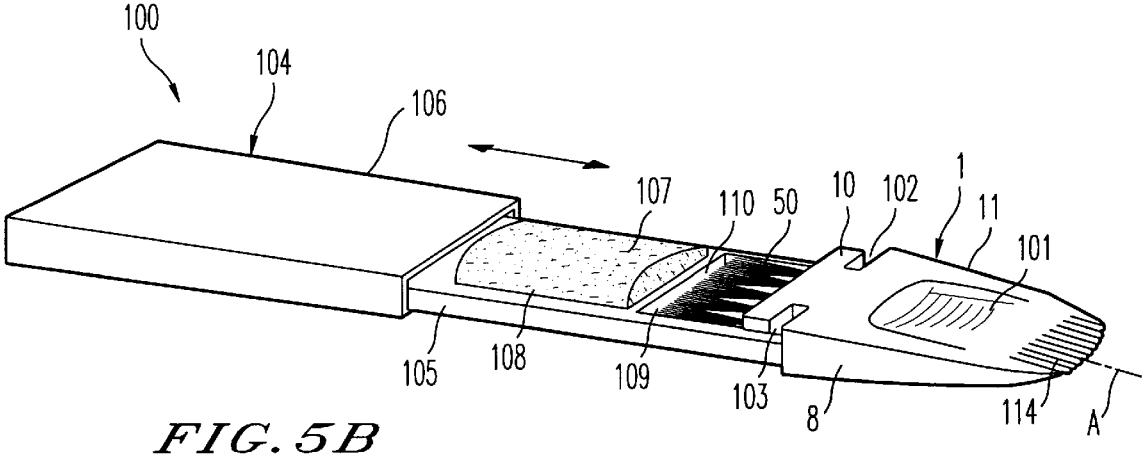
Figure 5C:
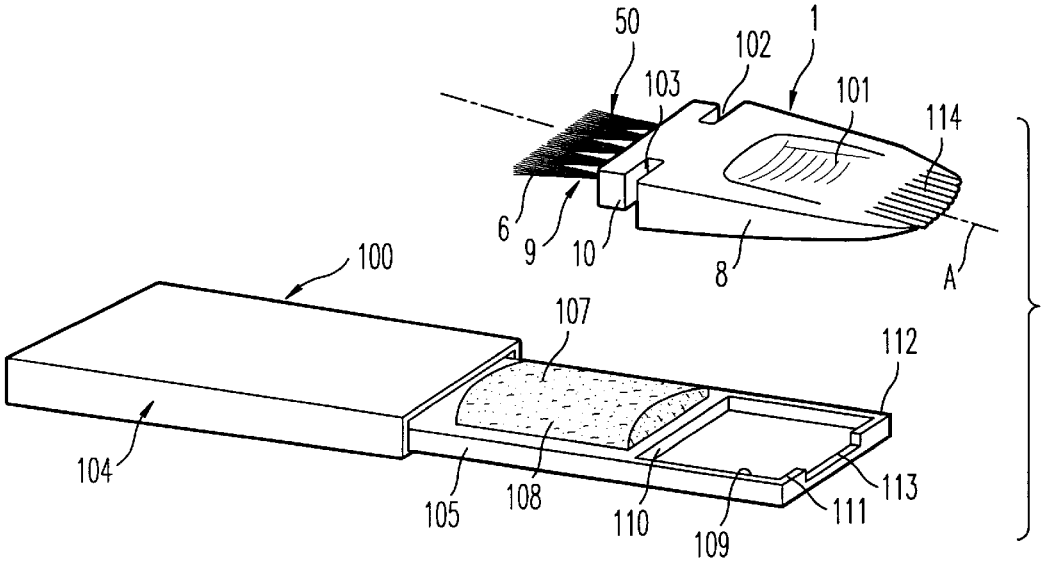

The packaging and application unit 100 illustrated in FIGS. 5A–5C has a substantially elongate shape, comprising a body 104 and an application device 1. In the embodiment illustrated, the applicator device 1 is mounted so that in the closed position unit 100 the handle 8 is at least partly outside the enclosed space delimited by the body 104 of the case. As shown in FIG. 5B, the body of the packaging and application unit 100 consists of a bottom 105 mounted in the manner of a sliding drawer inside a lid 106 forming a lid. By pulling the handle 8, the unit 100 is caused to open, thus permitting access to a block 107 of the solid or semi-solid product. The bottom 105 forms a receptacle having two compartments 108, 109 separated by a partition 110. The first compartment 108 contains a block 107 of the product in the form of a "loaf" or "cake." Alternatively, the semi-solid block is formed by a block of foam with open cells or half-open cells impregnated with the product in a fluid form. It may or may not be covered by a screen.

Advantageously, the product is a mascara for application to the eyelashes. The product may be cast or compacted inside the compartment 108, it being possible for appropriate means of the rib-type or other reliefs to be provided for holding the product in the bottom of the compartment 108. Alternatively, the block 107 may be mounted directly in solid form inside the compartment. By way of example, it may be bonded or force-fitted inside the compartment 108.

The second compartment 109 is intended to receive the applicator element 50. The applicator element has an arrangement of bristles, or of tufts of bristles, which may correspond to those which have been described with reference to FIGS. 1–3 and 4A–4I. Such an arrangement therefore does not require any other description.

The arrangement of the bristles is carried by the first end 10 of the handle 8. The applicator element has a width smaller than the width of the end 10 of the handle wherein the bristles are implanted, and also a width substantially smaller than the internal width of the compartment wherein it is kept in the storage position. Thus, during the insertion of the applicator element 50 into the unit and/or during storage, any damage to the bristles and in particular their free ends is avoided.

The handle 8 has its second part 11 which is, as shown in FIG. 5A, situated outside the unit 100 when the unit is closed. Two grooves 102, 103, shown in FIG. 5B, are disposed head-to-tail at the interface between the first end 10 and the second part 11 and are aligned along an axis perpendicular to the longitudinal axis A of the application device 1. The grooves 102 and 103 are U-shaped and have their respective bottoms situated opposite one another. These grooves 102, 103 are disposed so as to be inserted in portions of edges 111 and 112 of the bottom 105 (FIG. 5C). The edges 111 and 112 are separated by a recess 113 capable of receiving the part of the handle situated between the respective bottoms of the two grooves 102, 103. Thus, in the mounted position shown in FIG. 5B, the bristles rest substantially flat in the bottom of the compartment 109. The end 10 of the handle 8 has a cross-section slightly smaller than the internal cross-section lid 106 and is also disposed inside the compartment 109. The edges 111 and 112 of the in FIG. 5C showing the compartment 109 are inserted in the grooves 102 and 103, thus immobilizing the application device 1 axially in the unit 100. The handle 8 is outside the compartment 109. The application device 1 is pushed down into the compartment 109 by a movement in a plane parallel to itself. As will be seen more clearly in FIG. 5A, in the closed position, the second part 11 of the handle 8 adjacent to the body 104 outside the unit 100 has a cross-section substantially identical to the external cross-section of the lid 106 in FIG. 5B, so that the part 11 of the handle 8 is disposed in the extension of the body 104.

The end of the handle 8 on the side opposite to first the end 10 advantageously forms a comb 114 which, after the mascara has been applied by the applicator element 50, is used to separate the lashes which might cling together during the application of the product. This comb 114 advantageously forms a single piece with the handle 8. By way of example, the handle and unit are made by molding thermoplastic materials such as polyethylenes, polypropylenes, polyvinyl chlorides, polystyrenes, etc. Again by way of example, the handle is formed by an elastomeric material so as to give it a certain flexibility. At least one of the large sides of the handle 8 has a sunk portion 101 to facilitate the gripping of the application device 1 between the thumb and forefinger.

Figure 6A:
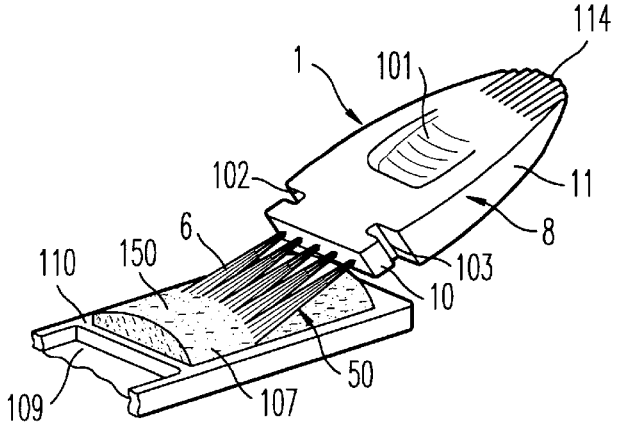
FIGS. 6A–6B illustrate the taking up of the product by an application device such as that used in the packaging and application unit in accordance with the invention.
Figure 6B:
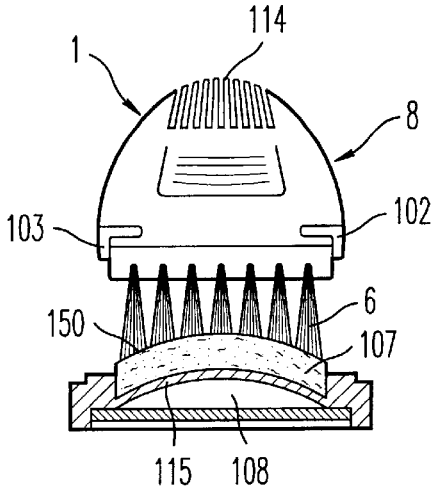

FIGS. 6A and 6B illustrate the taking up of the product by the application device 1. As is clearly shown in FIG. 6A, after having solubilized the product on its surface, (by saliva for example) the product is taken up by the applicator element 50 by inclining the application device 1 so as to place the bristles 6 into contact with the product over a substantial portion of its length and by displacing the applicator element 50 over the free surface 150 of the block 107. Thus, the bristles 6 are charged mainly over their lengths, in contrast to the conventional applicators of the type shown in FIG. 1, which are charged mainly at the ends of the bristles. However, it should be noted that if "moistening" of the surface of the cake is required, in particular for spreading the solubilizing liquid over a substantial surface of the "cake," the ends of the bristles may be used by keeping the brush substantially perpendicular to the free surface 150 of the product and by moving the handle 8 laterally through a sequence of small circles. The application of the mascara to the lashes is effected in the way indicated in FIG. 2 by smoothing the keratinous fibers, and eyelashes in particular, over their whole length from their base towards their ends, the bristles 6 of the applicator element 50 tangentially touching the eyelashes. After the product has been applied to the lashes, the application device 1 is optionally turned around and the lashes are combed by the comb 114 so as to separate the lashes which might have stuck together during the application.

FIG. 6B illustrates a sectional view of the block 107 of the product. The width of the bristles 6 is substantially equal to, or slightly smaller than, the width of the block of the product, so that the taking up is effected over substantially the whole width of the block. Thus, a regular and uniform wear of the free surface 150 of the block 107 is obtained, which even wear allows it to be completely used up in substantially identical conditions from the beginning to the end. In this embodiment, the bottom 115 of the compartment 108 is curved, which curvature gives the product block 107 the same curved profile. Such a configuration allows better use of the product and makes it possible to take up substantially the whole of the product contained in the compartment, while allowing the brush to be charged over substantially its whole width and a substantial portion of the length of the bristles composing it. In other words, because of the mode of the take-up, that is to say, by placing the bristles in a substantially flat manner on the surface of the "cake", the free surface of the "cake" can be given any profile, in particular concave or convex. If the semi-solid block is formed by a block of foam, the convex shape may be obtained by compressing the foam block over its periphery by a frame mounted on the compartment 108.

Figure 7:
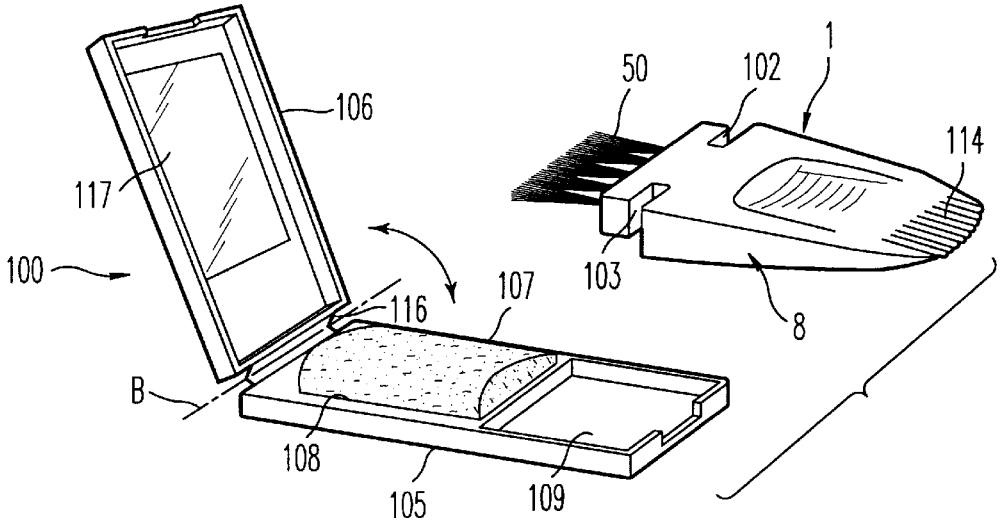
FIG. 7 illustrates a second embodiment of the packaging and application unit in accordance with the invention.

The embodiment of FIG. 7 is a variant of the embodiment of FIGS. 5A to 5C. According to this variant, the lid 106 is articulated on the bottom 105 around an axis of articulation B orientated perpendicularly to the longitudinal axis of the unit 100. The articulation is, for example, caused by a film hinge 116. A mirror 117 is mounted on the internal surface of the lid. Such a mirror may be mounted by bonding, welding, catch engagement or riveting. The application device 1 corresponds to that of the preceding embodiment. The width of the implantation of the bristles of the applicator element 50 is again smaller than the width of the end of the handle 8 in which the bristles are implanted.

Figure 8:
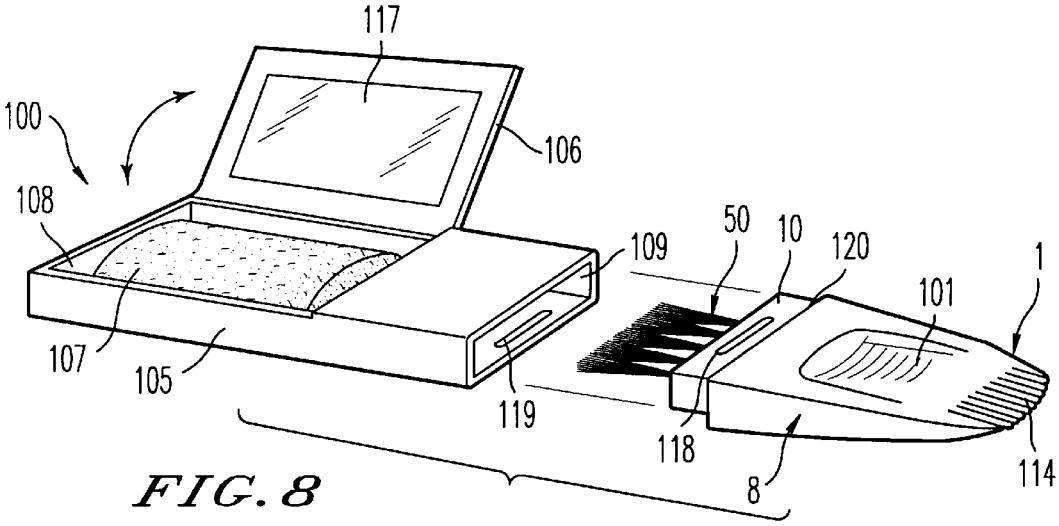
FIG. 8 illustrates a third embodiment of the packaging and application unit in accordance with the invention.

In the embodiment of FIG. 8, the lid 106 is articulated on the bottom 105 by a hinge pin parallel to the longitudinal axis of the unit 100. The lid is arranged so as to cover only the compartment 108. The compartment 109 in which the blade 6 applicator element 50 is disposed forms a parallelepiped-shaped unit 100 with a cross-section substantially identical to that of the rest of the case in its closed position. The casing is preferably closed at its end adjacent to the compartment 108. It is open at its other end, so as to allow the applicator element 50 to be inserted. The reduced dimensions of the width and also of the thickness of the applicator element relative to the end of the handle is especially advantageous in this embodiment. In this embodiment, the first end 10 of the handle 8 carrying the brush 6 applicator element 50 has an external cross-section slightly smaller than the internal cross-section of the compartment 109, so as to be capable of sliding in the unit 100. Ribs 118 provided on one and/or the other of the main sides of the part 10 cooperate by catch engagement with corresponding grooves 119 arranged on the internal surface of the unit 100 so as to immobilize the application device 1 in the thus obtained unit. The rest of the application device corresponds to that which has been described with reference to the other embodiments. In the mounted position, an edge 120 of the handle 8 adjacent to the first end 10 with the smaller cross-section abuts against the corresponding edge of the compartment 109.

Figure 9A:
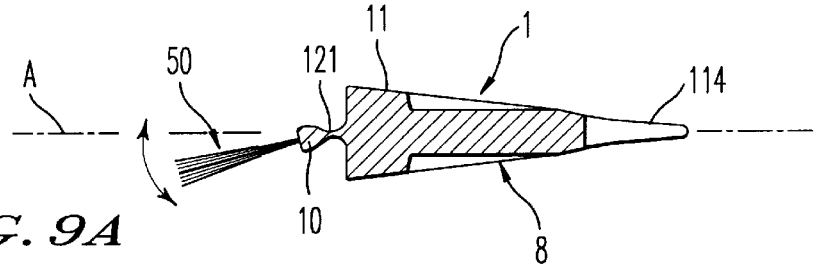
FIGS. 9A–9B illustrate a fourth embodiment of the packaging and application unit in accordance with the invention.
Figure 9B:
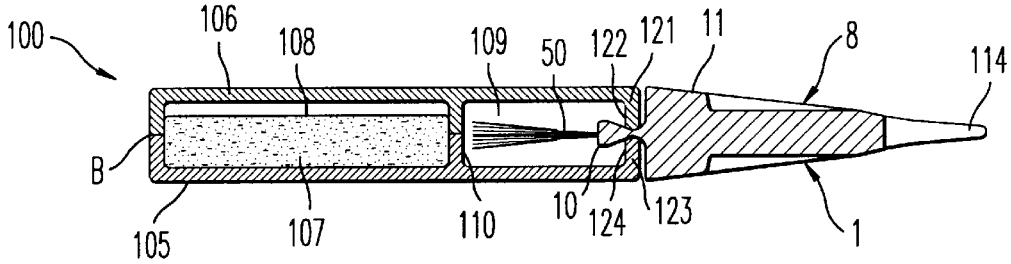

In the embodiment of FIGS. 9A and 9B, the application device 1 differs from that of the preceding embodiments in that the first end 10 carrying the applicator element 50 is articulated relative to the second part 11 of the handle 8. In an advantageous embodiment, the articulation is formed by a film hinge 121 in the median plane of the application device 1 and is orientated perpendicularly to the longitudinal axis A of the device 1. This orientation permits an inclination of the applicator element 50 relative to the axis of the handle, which improves the handling action. This inclination makes it possible to improve the dosing of the product on the applicator element and to facilitate the application of the product to the eyelashes, thus imparting greater comfort and greater precision to the application. Yet other means can be used for obtaining such an articulation. By way of example, the articulation is obtained by a profiled section, (one part is articulated on a cylinder carried by the other part). Alternatively, the handle is made of an elastomeric material to give it such a flexibility that is favorable to the taking up and application of the product.

As illustrated in FIG. 9B, the lid 106 is articulated on the bottom 105 around a hinge pin B situated on the side opposite to the application device 1. By closing the lid 106 on the bottom 105, a free edge 122 of the lid 106 comes to bear on the film hinge 121, the applicator element 50 being disposed inside the compartment 109 and separated from the block 107 by the partition 110. An edge 123 of the second part 11 of the handle 8 situated outside the unit 100 substantially abuts against the free edge 122 of the lid 106 and against an edge portion 124 formed by the bottom 105. Thus mounted, the application device 1 is immobilized both axially and in the median plane which it defines. The general form of the unit 100 is substantially identical with that of the embodiments described with reference to the other embodiments.

Figure 10:
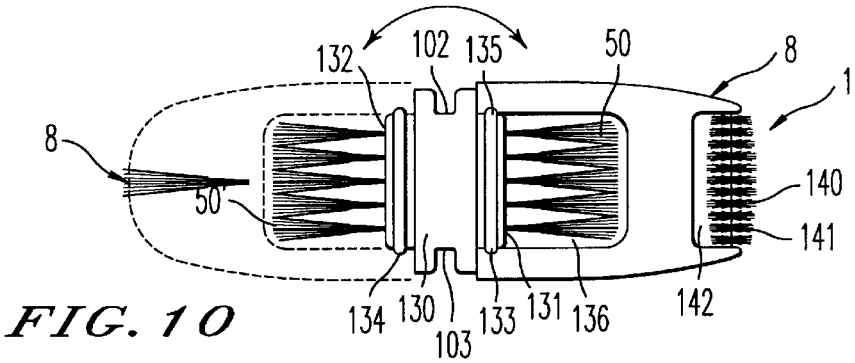
FIG. 10 illustrates another embodiment of an application device such as that used in a packaging and application unit in accordance with the invention.

FIG. 10 illustrates another embodiment of the application device 1 such as may be used in the packaging and application unit in accordance with the invention. In this embodiment, the handle 8 is detachably mounted on an applicator holder 130, whereof the applicator end 131 carries a first element 50 and whereof a second end 132 carries a second brush 50'. The handle has a hollow portion 136 so as to be capable of receiving the applicator element 50 which is not used. Each one of the first and second ends 131, 132 has a rib 133, 134 capable of cooperating in a detachable manner with a groove 135 arranged in the internal side of the hollow portion 136 of the handle 8, for locking the handle on the applicator holder 130 in a detachable manner. The handle thus fitted with one or the other of the brushes can be disposed and immobilized in a case, such as shown in FIGS. 5A–5C or 7, by the grooves 102, 103 in the applicator holder 130. For using the brush 50 instead of the brush 50', the user separates the handle from the applicator holder 130 and sets it up again by disposing the brush 50' in the handle by catch engaging the rib 134 in the groove 135. The second brush 50' may have bristles implanted, cut or processed in a way different from the bristles of the applicator element 50 for introducing still more variability into the make-up.

In the application device 1 illustrated in this FIG. 10, the comb is replaced by a third brush 140 comprising an arrangement of bristles disposed radially on a core 141, immobilized against rotation, inside an appropriate cutout 142 arranged at the end of the handle 8. The brush 140 is used in the same way as the comb for combing and separating the lashes which might have stuck together after the application of the mascara.

Figure 11:
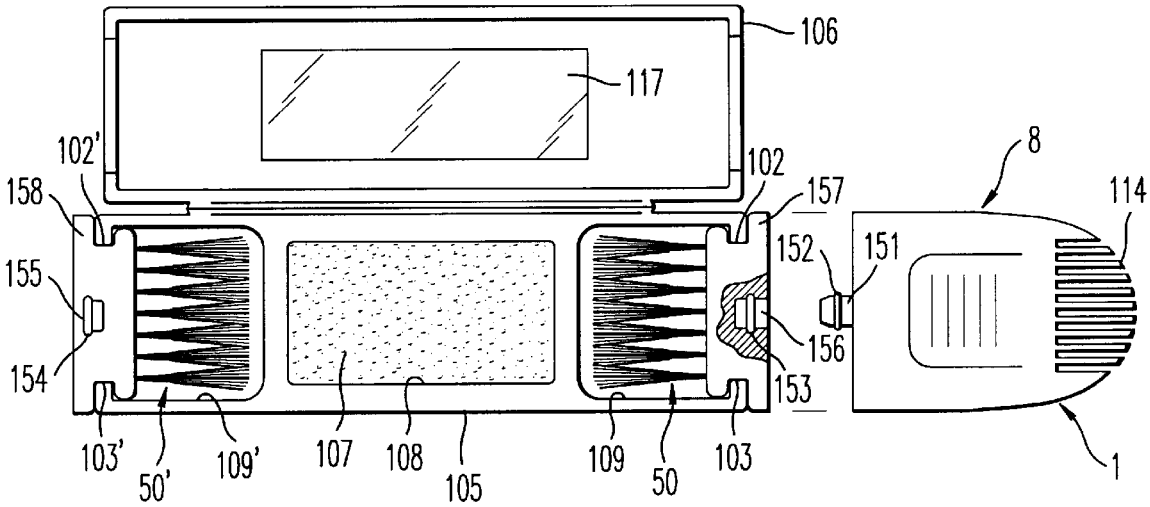
FIG. 11 illustrates a fifth embodiment of the packaging and application unit in accordance with the invention.

In the embodiment of FIG. 11, the two brushes 50 and 50' are independent of each other, the handle 8 being detachable so as to make it possible to use the applicator element 50 or the second brush 50' selectively. Each one of the brushes is disposed in one compartment 109 and 109' respectively disposed on either side of the compartment 108 containing the block 107. One of the ends of the handle 8 has a male element 151 provided with an annular rib 152 capable of being catch engaged in grooves 153, 154 arranged on the internal surface of female elements 155, 156 formed in supports 157, 158 of each of the brushes 50, 50'. The brushes 50 and 50' carried respectively by the supports 157 and 158 are respectively mounted in the compartments 109 and 109' of the case, by an arrangement with two grooves 102, 103 and 102', 103' respectively, corresponding to the arrangement which has been described with reference to FIGS. 5A–5C and 7. In the closed position of the lid 106 on the bottom 105, the female elements 155 and 156 of the supports 157 and 158 are accessible from the outside, to allow the brush to be changed in this closed position. The other parts of the case correspond to the description provided with reference to the other embodiments.

In the preceding detailed description, reference has been made to preferred embodiments of the invention. It is obvious that variants may be introduced into them without departing from the spirit of the invention, such as claimed below.

What is claimed is:

1. A packaging and application unit of a make-up product for keratinous fibers, comprising:

a body having a bottom and containing a solid or semi-solid block of the product;

a lid for detachably covering the bottom; and an application device including a handle having a substantially flat profile and carrying at least one applicator element disposable inside the body without substantial contact with the product, said applicator element having a free end and being formed by a plurality of bristles implanted in a first end of the handle and substantially parallel to a plane of the handle, the width of said free end of the applicator element measured along a first direction parallel to said plane being greater than 7.5 mm, the thickness of the free end of the applicator element measured along a second direction perpendicular to said plane being from 0.5 mm to 5 mm, and the length of said applicator element measured along a third direction perpendicular to the first and second directions being from 4 mm to 60 mm, wherein a ratio Φ of an effective surface of the set of bristles and a surface of the free end of the applicator element ranges from 0.10 to 0.5.

2. A packaging and application unit according to claim 1, wherein the handle has a second part tapered towards another end on a side opposite to the first end and also has on at least one side a sunk portion capable of facilitating gripping of the handle by a user.

3. A packaging and application unit according to claim 1, wherein the ratio Φ of the effective surface of the set of bristles and the surface of the free end of the applicator element is from 0.15 to 0.35.

4. A packaging and application unit according to claim 1, wherein the width of the applicator element measured along said first direction is substantially smaller than the width of said first end of the handle, said applicator element being substantially centered on said first end of the handle along the first direction.

5. A packaging and application unit according to claim 4, wherein the difference in width between the first end of the handle and the applicator element is from 1 mm to 5 mm.

6. A packaging and application unit according to claim 5, wherein the difference in width between the first end of the handle and the applicator element is from 2 mm to 4 mm.

7. A packaging and application unit according to claim 1, wherein, in a closed position of the lid on the bottom, the handle can be situated, at least in part, outside a substantially enclosed space formed by the lid and the bottom.

8. A packaging and application unit according to claim 1, wherein the lid is articulated on the bottom.

9. A packaging and application unit according to claim 1, wherein the handle has two parts articulated around an axis of articulation parallel to said first direction.

10. A packaging and application unit according to claim 9, wherein the axis of articulation is formed by a film hinge or a profiled section.

11. A packaging and application unit according to claim 9, wherein in the closed position of the lid on the bottom, the axis of articulation is contained inside the unit so as to immobilize the handle relative to said plane.

12. A packaging and application unit according to claim 1, wherein an end of the handle opposite said first end carries an element for separating the keratinous fibers after the application of the product.

13. A packaging and application unit according to claim 12, wherein said separating element is a comb.

14. A packaging and application unit according to claim 13, wherein the comb is molded together with the handle.

15. A packaging and application unit according to claim 12, wherein said separating element is formed by a brush having an arrangement of bristles disposed radially on a central core.

16. A packaging and application unit according to claim 1, wherein the make-up product is arranged in the bottom in the form of a block.

17. A packaging and application unit according to claim 1, wherein the block is a block of foam impregnated with said product in a fluid form.

18. A packaging and application unit according to claim 1, further comprising a second applicator element.

19. A packaging and application unit according to claim 18, wherein that the handle is detachable from the applicator element, allowing a selective use of one of said applicator elements.

20. A packaging and application unit according to claim 18, wherein one of said applicator elements is detachably mounted inside the handle.

21. A packaging and application unit according to claim 18, wherein said second applicator element is a liner brush.

22. A packaging and application unit according to claim 1, wherein the thickness of the said free end is at most equal to an average thickness of said first end of the handle.

23. A packaging and application unit according to claim 1, wherein the applicator element has a length of from 10 mm to 30 mm.

24. A packaging and application unit according to claim 23, wherein the applicator element has a length from 15 mm to 20 mm.

25. A packaging and application unit according to claim 1, wherein the bristles have a diameter ranging from 0.04 to 0.7 mm.

26. A packaging and application unit according to claim 25, wherein the bristles have a diameter ranging from 0.05 mm to 0.6 mm.

27. A packaging and application unit according to claim 26, wherein the bristles have a diameter ranging from 0.06 mm to 0.4 mm.

28. A packaging and application unit according to claim 1, wherein the make-up product is cast in one of a hot and a cold state in the bottom in the form of a block.

29. A packaging and application unit according to claim 1, wherein the bristles have at least one capillary groove.

30. A packaging and application unit according to claim 1, wherein the bristles have different lengths.

31. A packaging and application unit according to claim 1, wherein the bristles have at least one of a flocked coating and asperities.

32. A packaging and application unit according to claim 1, wherein the bristles comprise at least one of slip agents, bactericidal agents and moisture absorbing agents.

33. A packaging and application unit according to claim 1, wherein the bristles have undulations.

34. A packaging and application unit according to claim 1, wherein the bristles end in balls obtained by carding.

35. A packaging and application unit according to claim 1, wherein the bristles comprise a plurality of tufts disposed in at least one row.

36. A packaging and application unit according to claim 1, wherein the bristles have one of a bevelled shape, a convex shape and a concave shape.

37. A packaging and application unit according to claim 1, wherein the handle has an axially curved handle, the bristles being implanted along a curve substantially identical with the curvature of the handle.

38. A packaging and application unit according to claim 1, wherein the width of said free end of the applicator element is from 0.75 cm to 3 cm.

39. A packaging and application unit according to claim 1, wherein the make-up product is compacted in the bottom in the form of a block.

40. A packaging and application unit according to claim 1, wherein the thickness of the free end of the applicator element is from 1 mm to 3.5 mm.

41. A packaging and application unit according to claim 1, wherein the bristles have a hardness in the range from 10 Shore A to 90 Shore D.

42. A packaging and application unit according to claim 41, wherein the bristles have a hardness in the range from 30 Shore A to 60 Shore D.

43. A packaging and application unit according to claim 1, wherein the bristles are chosen from one of synthetic materials, metals and elastically deformable materials including elastomers, thermoplastic elastomers, vulcanized elastomers, thermoplastic Materials, vegetable fibers, animal fibers and natural fibers.

44. A packaging and application unit according to claim 27, wherein the bristles comprise one of extruded bristles and thermoplastic bristles duplex injection molded on the handle.

45. A packaging and application unit of a make-up product for keratinous fibers, comprising:

a body having a bottom and containing a solid or semi-solid block of the product;

a lid for detachably covering the bottom; and an application device comprising a handle having a substantially flat profile and carrying at least one applicator element disposable inside the body without substantial contact with the product, said applicator element having a free end and being formed by a plurality of bristles implanted in a first end of the handle and substantially parallel to a plane of the handle, the width of said free end of the applicator element measured along a first direction parallel to said plane being greater than 7.5 mm, the thickness of the free end of the applicator element measured along a second direction perpendicular to said plane being from 0.5 mm to 5 mm, and the length of said applicator element measured along a third direction perpendicular to the first and second directions being from 4 mm to 60 mm;

wherein in a closed position of the lid on the bottom, the handle can be situated, at least in part, outside a substantially enclosed space formed by the lid and the bottom; and wherein said lid is slidably mounted on the bottom, the handle comprising an actuating element for opening the unit to allow access to the block of the product.

* * * * *

UNITED STATES PATENT AND TRADEMARK OFFICE

CERTIFICATE OF CORRECTION

PATENT NO. : 6,073,634
DATED : June 13, 2000
INVENTOR(S) : Jean-Louis H. Gueret

It is certified that error appears in the above-identified patent and that said Letters Patent is hereby corrected as shown below:

Column 1,
Line 42, delete "means of";

Column 2,
Line 22, delete "and";

Column 10,
Line 34, change "first the" to -- the first --;

Column 11,
Line 22, after "and" insert -- over --;
Line 47, delete "blade 6";
Line 49, change "case" to -- unit 100 --;
Line 50, change "casing" to -- unit 100 --;
Line 57, delete "brush 6";

UNITED STATES PATENT AND TRADEMARK OFFICE

CERTIFICATE OF CORRECTION

PATENT NO. : 6,073,634
DATED : June 13, 2000
INVENTOR(S) : Jean-Louis H. Gueret

It is certified that error appears in the above-identified patent and that said Letters Patent is hereby corrected as shown below:

Column 12,
Line 43, change "brush" to -- element --;.
Line 53, change "brush" (first occurrence) to -- element --; and Column 16,
Line 5, change "Materials" to -- materials --.

Signed and Sealed this

Seventh Day of August, 2001

*Attest:*

Nicholas P. Godici

*Attesting Officer*

NICHOLAS P. GODICI
*Acting Director of the United States Patent and Trademark Office*